US008948679B2

(12) United States Patent
Murakami et al.

(10) Patent No.: US 8,948,679 B2
(45) Date of Patent: Feb. 3, 2015

(54) SHEET CONVEYANCE DEVICE AND IMAGE FORMING APPARATUS INCLUDING SAME

(75) Inventors: Hiroaki Murakami, Kawasaki (JP); Yasuhisa Ehara, Kamakura (JP); Noriaki Funamoto, Machida (JP); Tetsuji Nishikawa, Machida (JP); Yasuhiro Maehata, Sagamihara (JP); Jun Yasuda, Matsudo (JP); Satoshi Araaki, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 263 days.

(21) Appl. No.: 12/923,110

(22) Filed: Sep. 2, 2010

(65) Prior Publication Data

US 2011/0058870 A1 Mar. 10, 2011

(30) Foreign Application Priority Data

Sep. 7, 2009 (JP) ..... 2009-205852
May 26, 2010 (JP) ..... 2010-120393

(51) Int. Cl.
*G03G 15/00* (2006.01)
*B41J 13/02* (2006.01)
*B65H 5/06* (2006.01)

(52) U.S. Cl.
CPC ..... *B41J 13/025* (2013.01); *B65H 5/062* (2013.01); *G03G 15/6558* (2013.01);
(Continued)

(58) Field of Classification Search
CPC ..... B65H 2403/60; B65H 2404/143; B41J 13/025
USPC ..... 399/388, 395, 332; 271/272
See application file for complete search history.

(56) References Cited

U.S. PATENT DOCUMENTS 6,019,366 A * 2/2000 Tranquilla ..... 271/274
6,141,883 A * 11/2000 Mitchell et al. ..... 33/501.02
(Continued)

FOREIGN PATENT DOCUMENTS

JP 08-026519 A 1/1996
JP 11158740 A * 6/1999
JP 2003-146487 5/2003

OTHER PUBLICATIONS

"Lubricating Basics" authored by Arne Koose; Published on Mar. 18, 2002 by Nachi Technical Center; Last page inserted by examiner ("modified" date) to reflect publication date ("created" on date) Relevant pp. 3 (Definition of NLGI grades), 5 (prior use of an NLGI Grade 3 grease) , and 10 (citing publication date).*
(Continued)

*Primary Examiner* — Daniel J Colilla
*Assistant Examiner* — John M Royston
(74) *Attorney, Agent, or Firm* — Harness, Dickey & Pierce P.L.C.

(57) ABSTRACT

A sheet conveyance device for conveying a recording medium includes a fixed roller, a movable roller, an urging member, and a shock absorber, and an image forming apparatus including the sheet conveyance device. The position of the fixed roller is fixed. The movable roller is disposed opposite the fixed roller to contact the fixed roller, thereby defining a nip. The urging member urges the movable member to contact the fixed roller in the absence of the recording medium in the nip and allows the movable member to separate from the fixed roller by an amount corresponding to a thickness of a recording medium when the recording medium enters the nip. The shock absorber absorbs displacement energy generated when the urging member urges the movable roller to contact the fixed roller again after the recording medium passes through the nip.

19 Claims, 5 Drawing Sheets

(52) U.S. Cl.
CPC ..... *B65H 2401/15* (2013.01); *B65H 2402/525* (2013.01); *B65H 2403/60* (2013.01); *B65H 2404/143* (2013.01); *B65H 2404/144* (2013.01); *B65H 2601/524* (2013.01); *B65H 2801/06* (2013.01)
USPC ..... 399/395; 399/388

(56) References Cited

U.S. PATENT DOCUMENTS

| | | | | |
|---|---|---|---|---|
| 7,174,115 | B2 * | 2/2007 | Ahn | 399/110 |
| 7,264,096 | B2 * | 9/2007 | Hayashi et al. | 188/290 |
| 7,455,295 | B2 * | 11/2008 | Marx et al. | 271/273 |
| 7,523,933 | B2 * | 4/2009 | Linder et al. | 271/274 |
| 2007/0018387 | A1 * | 1/2007 | Yamamoto | 271/272 |
| 2008/0251998 | A1 * | 10/2008 | Muneyasu et al. | 271/227 |

OTHER PUBLICATIONS

Japanese Office Action dated Dec. 17, 2013 for corresponding Japanese Application No. 2010-120393.

* cited by examiner

SHEET CONVEYANCE DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application Nos. 2009-205852, filed on Sep. 7, 2009, and 2010-120393, filed on May 26, 2010, both in the Japan Patent Office, which are hereby incorporated herein by reference in their entirety.

BACKGROUND OF THE INVENTION

1. Field of the Invention

Exemplary aspects of the present invention generally relate to a sheet conveyance device and an image forming apparatus, such as a copier, a facsimile machine, a printer, or a digital multi-functional system including a combination thereof, and more particularly, to a sheet conveyance device including a pair of rollers and an image forming apparatus including the sheet conveyance device.

2. Description of the Background Art

Generally, a sheet conveyance device employed in image forming apparatuses such as a copier, a facsimile machine, a printer, or a digital multi-functional system including a combination thereof includes a pair of rollers that sandwiches a recording medium to convey it to a predetermined position within the apparatus.

Such a pair of rollers consists of a fixed roller, the position of which is fixed, and a movable roller urged by an urging member, for example, a spring or the like, against the fixed roller, so that the movable roller contacts the fixing roller defining a nip therebetween. When a recording medium advances to the nip, the movable roller separates from the fixed roller by an amount corresponding to a thickness of the recording medium being conveyed against an urging force of the urging member, thereby allowing the recording medium to enter the nip.

As the recording medium is conveyed to the nip defined by and between the fixed roller and the movable member, a frictional force between the recording medium and one of the rollers which is a drive roller is transferred to the other roller (the driven roller) due to an urging force of the urging member, thereby rotating the driven roller. Subsequently, as the recording medium exits from the nip, the movable roller returns to the fixed roller side due to the urging force of the urging member, contacting the fixed roller again.

There is a drawback to this configuration in that after the recording medium passes through the nip between the pair of rollers, the movable roller is urged to the fixed roller side due to the urging force of the urging member to form the nip again, striking the fixed roller and thus producing undesirable vibration.

Such vibration shakes an optical writing unit, for example, an exposure device, in the image forming apparatus, and an ink-jet recording head of the image forming apparatus through the sheet conveyance device or a main body of the image forming apparatus, thereby generating striped patterns known as shock jitter in a resulting output image. Unfortunately, such jitter caused by the pair of rollers striking each other defeats the purpose of producing an image of ever higher quality.

To address such a problem, various methods have been proposed to reduce vibration. For example, Japanese Patent. Application Publication No. 2003-146487 (hereinafter "JP-A") proposes to attach a flywheel to a shaft of a drive roller of a pair of registration rollers, thereby preventing vibration of the registration rollers.

Typically, a drive transmission system that drives a pair of registration rollers includes a drive motor that drives one of the pair of registration rollers, that is, the drive roller, and a gear that transmits the drive force to the drive roller, enabling the registration rollers to rotate. As the drive motor and the gear engage, vibration is generated undesirably. According to JP-2003-146487-A, however, providing a flywheel to the shaft of the drive roller may prevent the registration rollers from vibration.

In this configuration, even when vibration generated in the drive transmission system which transmits the drive force to the drive roller of the registration rollers is transmitted to the drive roller, the flywheel of the drive roller may transfer a resonance frequency of the drive roller, thus preventing sympathetic vibration of the drive roller. As a result, the drive roller is prevented from vibrating, thus preventing transmission and amplification of the vibration of the drive roller to the recording medium. Ultimately, vibration is prevented from leaking out of the image forming apparatus as noise.

Although advantageous, this configuration only reduces vibration caused by the drive motor that drives the pair of registration rollers engaging the gear that transmits the drive force to the drive roller of the registration rollers. Accordingly, vibration generated in the drive transmission system consisting of the drive source and the gear may be prevented from getting transmitted to the recording medium.

In other words, even if the flywheel is attached to one of shafts of the fixed roller and the movable roller, this configuration does not reduce or prevent vibration when the pair of rollers strikes each other as the recording medium exits from the nip between the rollers.

In view of the foregoing, a device that can reduce vibration caused by the pair of rollers striking each other, thus reducing jitter when the recording medium exits therefrom, is required.

SUMMARY OF THE INVENTION

In view of the foregoing, in one illustrative embodiment of the present invention, a sheet conveyance device to convey a recording medium includes a fixed roller, a movable roller, an urging member, and a shock absorber. The position of the fixed roller is fixed. The movable roller is disposed opposite the fixed roller to contact the fixed roller, thereby defining a nip. The urging member urges the movable member to contact the fixed roller in the absence of the recording medium in the nip, and allows the movable member to separate from the fixed roller by an amount corresponding to a thickness of a recording medium when the recording medium enters the nip. The shock absorber absorbs displacement energy generated when the urging member urges the movable roller to contact the fixed roller again after the recording medium passes through the nip.

In another illustrative embodiment of the present invention, an image forming apparatus includes a sheet conveyance device to convey a recording medium. The sheet conveyance device includes a fixed roller, a movable roller, an urging member, and a shock absorber. The position of the fixed roller is fixed. The movable roller is disposed opposite the fixed roller to contact the fixed roller, thereby defining a nip. The urging member urges the movable member to contact the fixed roller in the absence of the recording medium in the nip, and allows the movable member to separate from the fixed roller by an amount corresponding to a thickness of a recording medium when the recording medium enters the nip. The shock absorber absorbs displacement energy generated when the urging member urges the movable roller to contact the fixed roller again after the recording medium passes through the nip.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
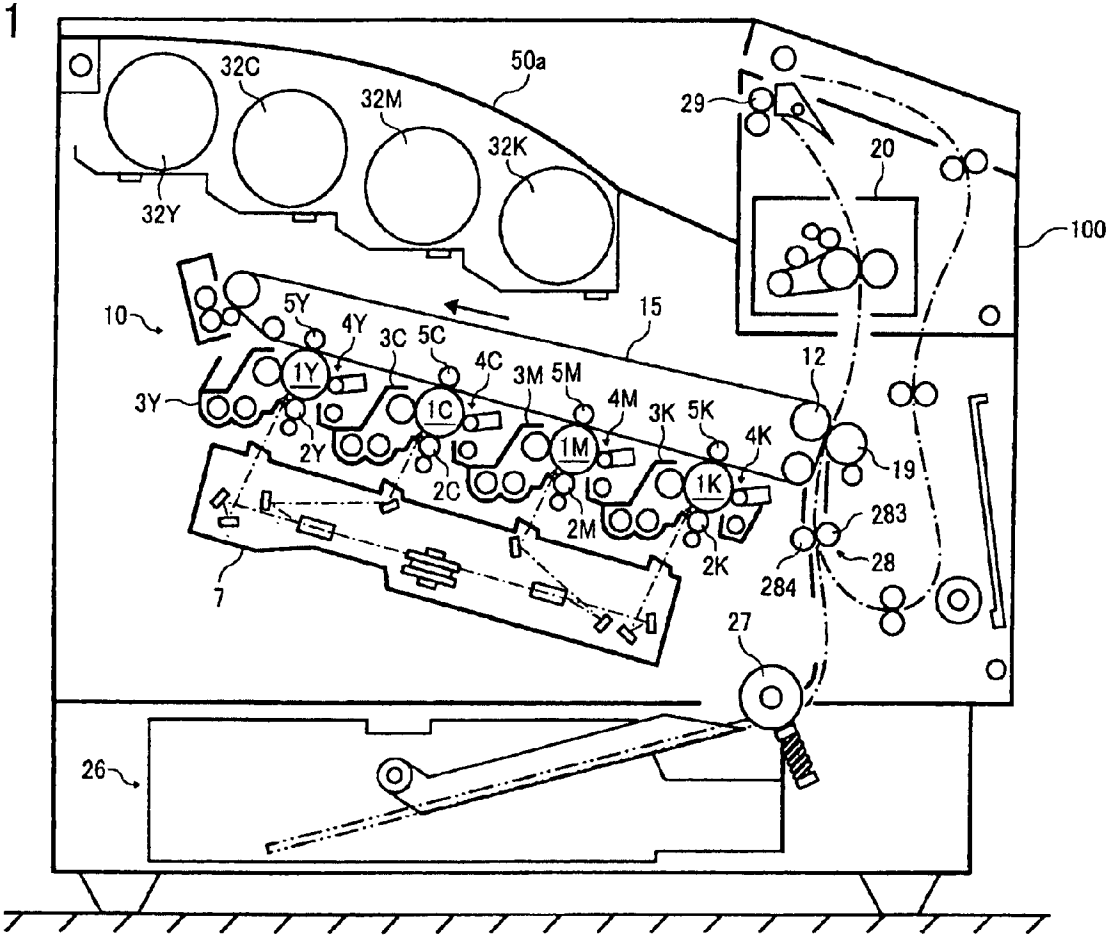
FIG. 1 is a schematic diagram illustrating an example of an image forming apparatus employing a sheet conveyance device according to an illustrative embodiment.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating an example of the image forming apparatus in which a sheet conveyance device according to the illustrative embodiment is employed.

In FIG. 1, an image forming apparatus 100 is an electrophotographic full-color printer known by those skilled in the art. However, the present invention is not limited to the image forming apparatus using an image forming method and an image transfer method. For example, the present invention can be applied to an image forming apparatus using an inkjet recording method, a monochrome image forming apparatus, and so forth. As long as an image forming apparatus includes the sheet conveyance device of the present invention, vibration generated by rollers striking each other when transporting the recording medium is reduced if not prevented entirely, thus preventing jitter.

In FIG. 1, the image forming apparatus 100 includes an image forming device 10 including four photoreceptor drums 1Y, 1C, 1M, and 1K serving as latent image bearing members, an intermediate transfer belt which is an endless looped belt 15, charging rollers 2Y, 2C, 2M, and 2K, developing devices 3Y, 3C, 3M, and 3K, cleaning devices 4Y. 4C, 4M, and 4K, primary transfer rollers 5Y, 5C, 5M, and 5K, an exposure unit 7, a fixing device 20, and so forth.

The four photoreceptor drums 1Y, 1C, 1M, and 1K serving as the latent image bearing members on which toner images yellow (Y), cyan (C), magenta (M), and black (K) are formed are disposed substantially at center of the image forming apparatus 100. The four photoreceptor drums 1Y, 1C, 1M, and 1K are arranged equally spaced along the surface of the intermediate transfer belt 15 while contacting the intermediate transfer belt 15 under the intermediate transfer belt 15.

It is to be noted that reference characters Y, C, M, and K denote the colors yellow, cyan, magenta, and black, respectively.

During image forming operation, the photoreceptor drums 1Y, 1C, 1M, and 1K are rotated in a clockwise direction by a drive source, not illustrated.

The intermediate transfer belt 15 is wound around and stretched between a plurality of rollers, one of which is driven by a drive source and called a drive roller. As the drive roller is driven to rotate, the intermediate transfer belt 15 is rotated in a counterclockwise direction indicated by an arrow in FIG. 1.

Each of the photoreceptor drums 1Y, 1C, 1M, and 1K includes an aluminum cylinder of approximately 30 to 120 mm on which a photoelectric organic semiconductive layer is deposited.

Around each of the photoreceptor drums 1Y, 1C, 1M, and 1K, the charging rollers 2Y, 2C, 2M, and 2K, the developing devices 3Y, 3C, 3M, and 3K, and the cleaning devices 4Y. 4C, 4M, and 4K are sequentially arranged in the direction of rotation of the photoreceptor drums 1Y, 1C, 1M, and 1K. Furthermore, in the inner loop of the inter mediate transfer belt 15, the primary transfer rollers 5Y, 5C, 5M, and 5K each serving as a primary transfer mechanism are arranged across from the respective photoreceptor drums 1Y, 1C, 1M, and 1K.

Each of the developing devices 3Y, 3C, 3M, and 3K includes a developing roller, a developing blade, a mixing/conveyance screw, and so forth. Each of the cleaning devices 4Y, 4C, 4M, and 4K includes a cleaning brush, a cleaning blade, a mixing screw, and so forth.

The exposure unit 7 serving as an optical writing mechanism that forms an electrostatic latent image on each of the photoreceptor drums 1Y, 1C, 1M, and 1K is disposed substantially below the photoreceptor drums 1Y, 1C, 1M, and 1K. The exposure unit 7 illuminates surfaces of the photoreceptor drums 1Y, 1C, 1M, and 1K charged by the charging rollers 2Y, 2M, 2C, and 2K, with laser beams corresponding to image data of each toner color. The exposure unit 7 is an exposure mechanism of a laser scan method employing laser light sources, a polygon mirror, and so forth. Four semiconductor laser light sources, not illustrated, of the exposure unit 7 project light modulated in accordance with image data. Then, each light illuminates the surface of the respective photoreceptor drums 1Y, 1C, 1M, and 1K through optical components such as an aperture lens, the polygon mirror, a scan lens, and a mirror. Accordingly, the electrostatic latent image is formed on each of the photoreceptor drums 1Y, 1C, 1M, and 1K.

Each of the developing devices 3Y, 3C, 3M, and 3K is provided with two screws for mixing toner with carrier. The toner is supplied from each of toner cartridges 32Y, 32C, 32M, and 32K by toner supply members connected to the toner cartridges. The fresh toner supplied from the toner cartridges or the toner already stored in the developing devices 3Y, 3C, 3M, and 3K is mixed with carrier by the screws and conveyed to the surface of the respective developing roller while the thickness of the toner layer is regulated by a blade member, thereby forming a layer of a developing agent on the surface of each developing roller.

As the electrostatic latent images formed on each of the photoreceptor drums 1Y, 1C, 1M, and 1K pass through the developing devices 3Y, 3C, 3M, and 3K, the electrostatic latent images are developed with the respective toner layers, forming visible images, also known as toner images.

Substantially below the exposure device 7 serving as the writing mechanism, a sheet feed cassette 26 including a sheet feed roller 27 is disposed to store a stack of recording media sheets. The recording medium picked up by the sheet feed roller 27 from the sheet feed cassette 26 is conveyed to a pair of registration rollers 28.

Substantially above the pair of the registration rollers 28, a transfer roller 19 serving as a secondary transfer member is disposed facing a transfer opposing roller 12 which is one of the rollers around which the intermediate transfer belt 15 is wound. The transfer roller 19 and the transfer opposing roller 12 contact through the intermediate transfer belt 15, thereby defining a secondary transfer portion. The toner image is transferred onto the recording medium in the secondary transfer portion.

The developing device 20 is disposed substantially above the secondary transfer portion.

Next, a description is provided of an image forming operation. Forming toner images on the photoreceptor drums 1Y, 1C, 1M, and 1K, and transferring the toner images onto the intermediate transfer belt 15 are substantially the same between the photoreceptor drums 1Y, 1C, 1M, and 1K, differing only in the color of toner employed. Therefore, to simplify the description, the reference characters Y, M, C, and K indicating colors are omitted herein unless otherwise specified.

First, the photoreceptor drum 1 is rotated in the clockwise direction by a drive source, not illustrated. Light projected from a charge neutralizing device, not illustrated, illuminates the surface of the photoreceptor drum 1, thereby initializing a surface potential of the surface of the photoreceptor. Subsequently, the surface of the photoreceptor drum 1, whose surface potential has been initialized, is charged uniformly to a predetermined polarity by the charging roller 2.

The exposure device 7 illuminates the charged surface of the photoreceptor drum 1 with light, thereby forming an electrostatic latent image on the surface thereof. Image information to be exposed on each of the photoreceptor drums is a single-color image information decomposed into each toner color information, yellow, cyan, magenta, and black.

When passing through the developing device 3, the electrostatic latent image formed on the photoreceptor drum 1 is supplied with toner from the developing device 3, thereby forming a visible image, also known as a toner image.

The intermediate transfer belt 15 rotates in the counterclockwise direction. The primary transfer roller 5 is supplied with a transfer voltage having a polarity opposite the polarity of the toner of the toner image formed on the photoreceptor drum 1.

In this configuration, a transfer electric field is formed between the photoreceptor drum 1 and the intermediate transfer belt 15. The toner image on the photoreceptor drum 1 is electrostatically and primarily transferred onto the intermediate transfer belt 15 which rotates in synchronization with the photoreceptor drum 1.

The toner images of different colors formed on the respective photoreceptor drums are transferred sequentially and overlappingly onto the intermediate transfer belt 15 from upstream in the direction of movement of the intermediate transfer belt 15. Accordingly, a composite full-color image is formed on the intermediate transfer belt 15.

In the meantime, the recording medium in the sheet feed cassette 26 is picked up and conveyed by the sheet feed roller 27 to the pair of the registration rollers 28. At this time, the pair of registration rollers 28 is not rotating. As the leading edge of the recording medium being conveyed contacts a nip portion where the pair of the registration rollers 28 meets and contacts each other, the recording medium is aligned and the pair of the registration rollers 28 starts to rotate in appropriate timing such that the recording medium is aligned with the toner image formed on the intermediate transfer belt 15. The recording medium is fed to the secondary transfer portion.

According to the present embodiment, the transfer voltage having the polarity opposite the polarity of the toner of the toner image on the surface of the intermediate transfer belt 15 is applied to the transfer roller 19. Thus, the full-color toner image formed on the intermediate transfer belt 15 is transferred onto the recording medium.

The recording medium on which the toner image is transferred is conveyed to the fixing device 20. When passing through the fixing device 20, a fixing roller and a pressure roller of the fixing device 20 apply heat and pressure to the recording medium, thereby fixing the toner image on the recording medium. After the image is fixed onto the recording medium, the recording medium is discharged by a pair of sheet discharge rollers 29 onto a sheet tray 50*a* provided on the upper surface of the image forming apparatus 100.

When the recording medium is conveyed to the pair of the registration rollers 28, but the recording medium has not yet arrived at the registration rollers 28, the pair of the registration rollers 28 is in contact with each other, thereby forming the nip. The pair of registration rollers 28 consists of a drive roller 283 (also referred to as a fixed roller) and a driven roller 284 (also referred to as a movable roller). The drive roller 283 consists of a metal shaft 281 and an elastic member 282 such as rubber. The driven roller 284 is made solely of a metal shaft. The driven roller 284 is disposed opposite the drive roller 283.

As described above, when the leading edge of the recording medium arrives at the nip portion between the pair of the registration rollers 28 and is aligned, conveyance of the recording medium to the secondary transfer portion is initiated in appropriate timing such that the recording medium is aligned with the toner image on the intermediate transfer belt 15.

When the recording medium is ready to be conveyed, the drive roller 283 of the registration roller starts to rotate, enabling the driven roller 284 to rotate. Rotation of the pair of registration rollers 28 takes the leading edge of the recording medium into the nip. At this time, one of the registration rollers 28, that is, the driven roller 284, serves as a movable roller that moves away from the other roller, that is, the drive roller 283 (fixed roller) by an amount corresponding to the thickness of the recording medium.

According to the illustrative embodiment, the drive roller 283 serves as the fixed roller (hereinafter referred to as the fixed roller 283), the position of which is fixed. The driven roller 284 serves as the movable roller (hereinafter referred to as the movable roller 284), the position of which is changeable by an urging member 287.

Furthermore, the movable roller 284 is urged by the urging member 287 in the direction in which the movable roller 284 contacts the fixed roller 283, thereby defining the nip therebetween. However, when the recording medium advances to the nip, the urging member 287 is configured to allow the movable roller 284 to separate from the fixed roller 283 in accordance with the thickness of the recording medium.

After the recording medium passes through the pair of the registration rollers 28, that is, between the movable roller 284 and the fixed roller 283, the movable roller 284 is urged toward the fixed roller 283 by the urging force of the urging member 287 by an amount equal to the thickness of the recording medium that has passed the nip, thereby causing the movable roller 284 to contact the fixed roller 283.

As a result, when the movable roller 284 contact the fixed roller 283, vibration occurs and is transmitted undesirably to the exposure device 7 and the optical devices such as mirrors in the exposure device 7. When the exposure device 7 and so forth are vibrated, striped patterns known as shock jitter are generated in a resulting output image. Thus, the vibration needs to be reduced, if not prevented entirely.

In view of the above, according to the illustrative embodiment of the present invention, grease 289 serving as a shock absorber (or a decelerator) is provided to absorb displacement energy generated by the movable roller 284 striking the fixed roller 283 due to the urging force of the urging member 287.

Figure 2:
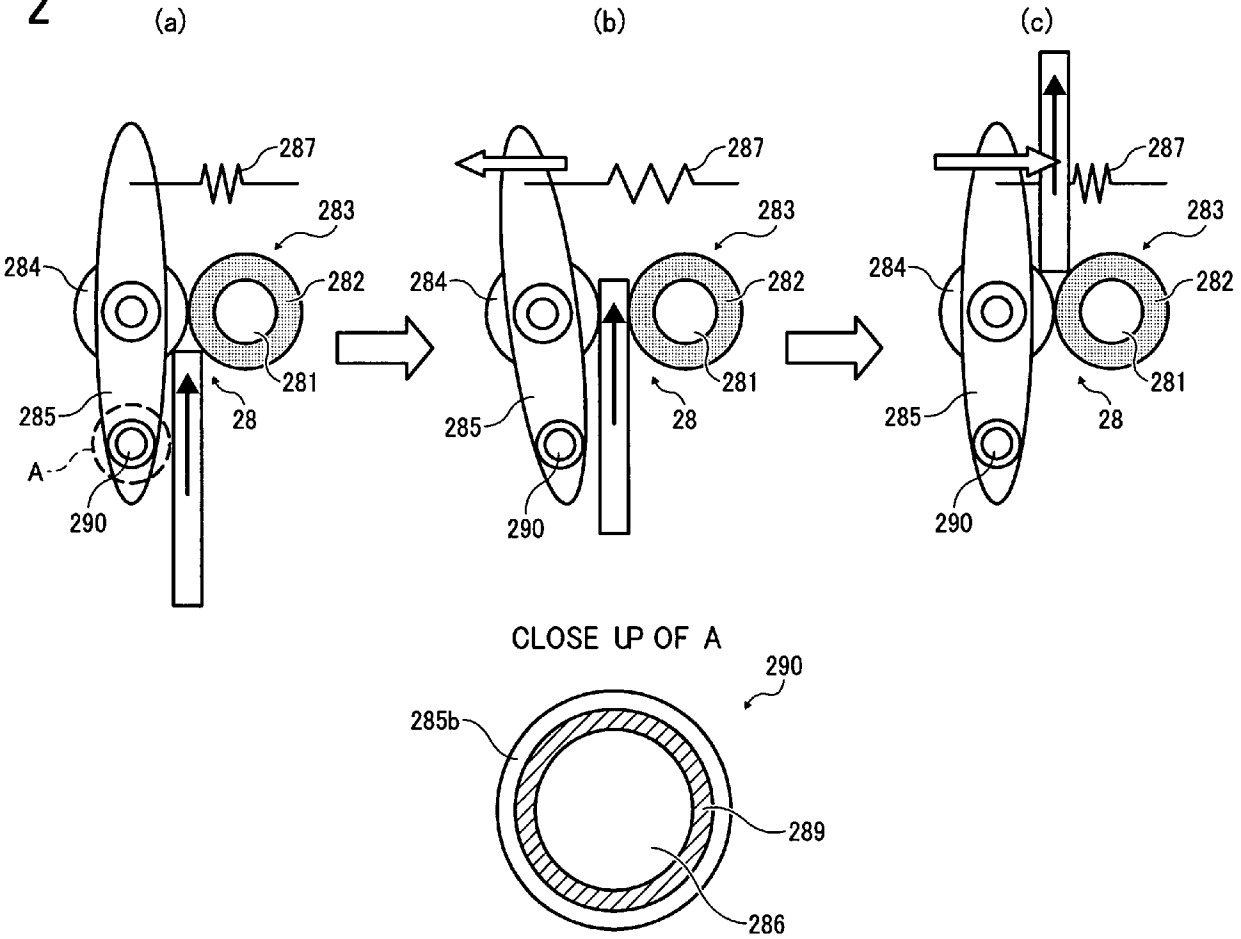
FIG. 2 is a schematic cross-sectional diagram illustrating a shock absorbing mechanism employed in the sheet conveyance device of FIG. 1 in operation according to an illustrative embodiment.
Figure 3:
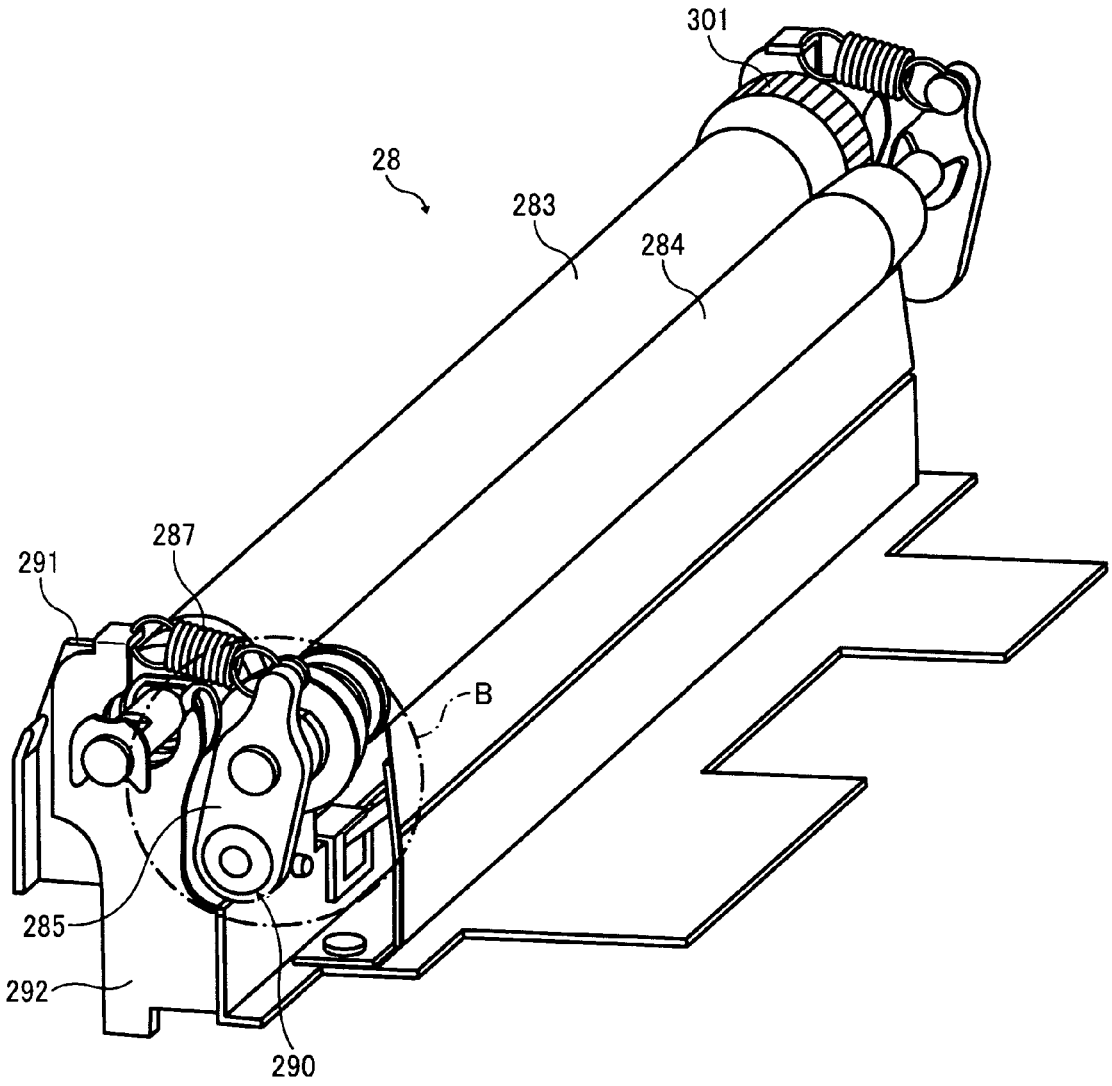
FIG. 3 is a schematic diagram illustrating the sheet conveyance device employing the shock absorbing mechanism according to an illustrative embodiment.
Figure 4:
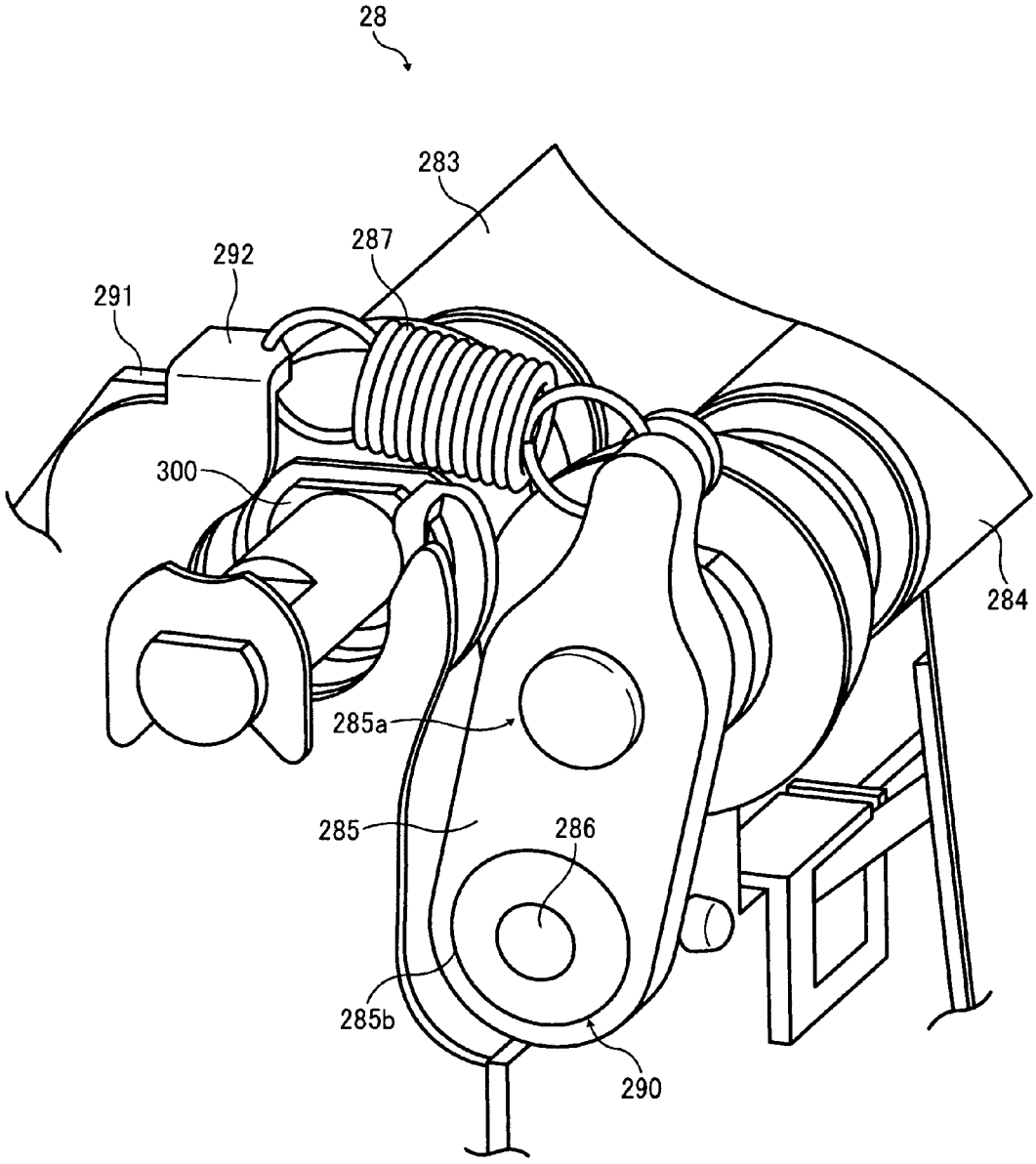
FIG. 4 is a enlarged perspective view of a portion indicated by a broken-line circle B in FIG. 3.
Figure 5:
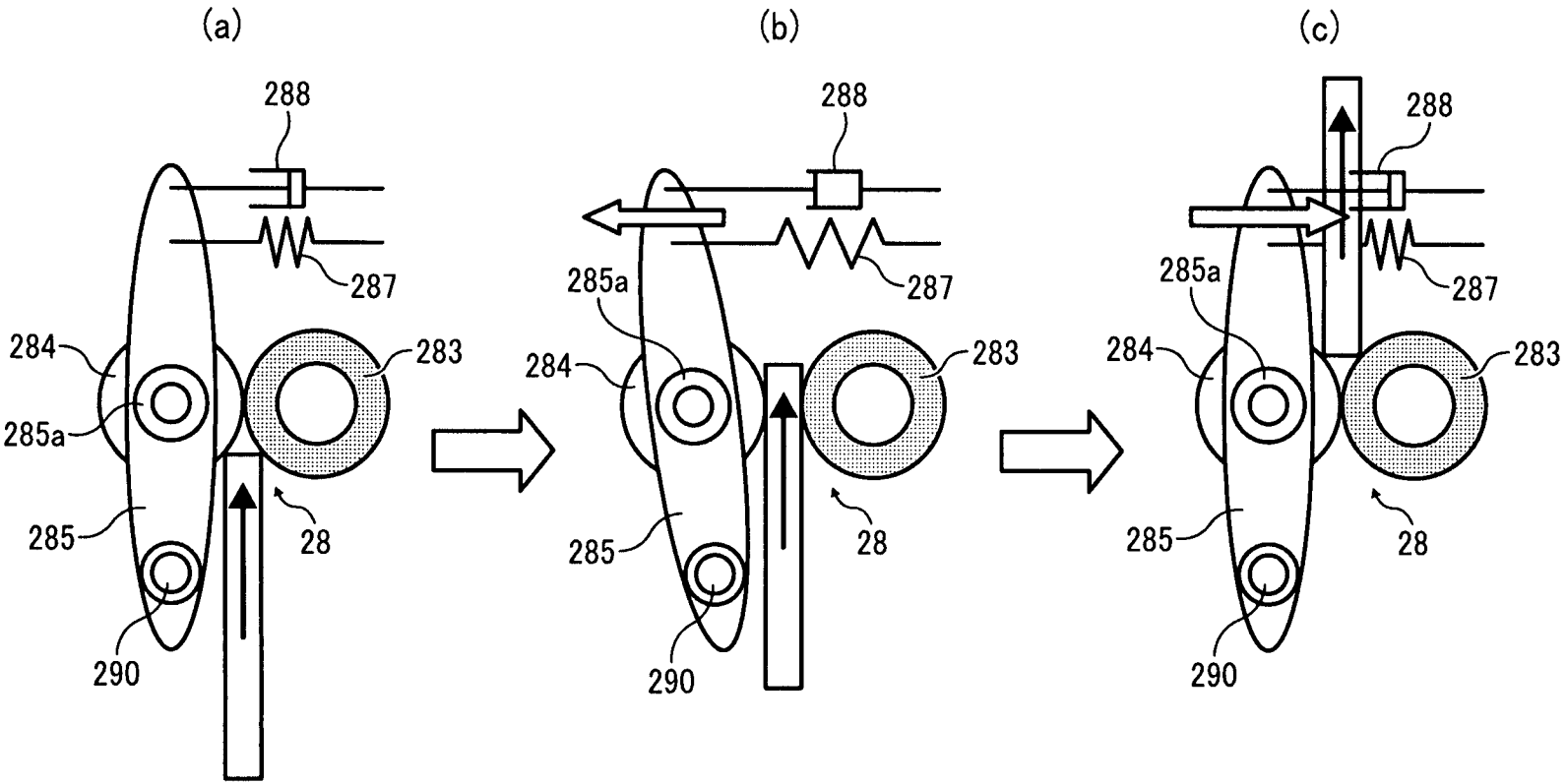
FIG. 5 is a schematic cross-sectional diagram illustrating the sheet conveyance device in operation, employing a different type of shock absorbing mechanism.

Referring now to FIGS. 2 through 5, a description is provided of the sheet conveyance device employing the grease 289 serving as the shock absorber according to the illustrative embodiment of the present invention. FIG. 2 is a schematic cross-sectional diagram illustrating a shock absorbing mechanism of the sheet conveyance device in operation. FIG. 3 is a schematic diagram illustrating the sheet conveyance device employing the shock absorbing mechanism of FIG. 2. FIG. 4 is a partially enlarged perspective view of FIG. 3. FIG. 5 is a schematic cross-sectional diagram illustrating the sheet conveyance device employing another example of the shock absorbing mechanism.

It is to be noted that FIGS. 2 and 5 illustrate the cross section of the pair of the registration rollers 28 as viewed from a distal end of the image forming apparatus 100. Therefore, the relative positions of the movable roller 284 and the fixed roller 283 is opposite the relative positions thereof shown in FIG. 1.

FIG. 2 illustrates one example of the sheet conveyance device employing the grease 289 as the shock absorber. As illustrated in FIG. 2, the sheet conveyance device includes the fixed roller 283, the movable roller 284 that forms the nip by contacting the fixed roller 283, and the urging member 287. The urging member 287 is, for example, a spring, which allows the movable roller 284 to separate from the fixed roller 283 in accordance with the thickness of the recording medium when the recording medium enters the nip between the fixed roller 283 and the movable roller 284.

The movable roller 284 is supported at the image forming apparatus side by a roller support member 285 to which the urging member 287 is connected. The roller support member 285 is one example of a support member connected with the urging member 287 and includes a rotation supporting portion 290 consisting of a movable roller bearing 285*b* and a rotary shaft 286. The rotary shaft 286 is fitted into the movable roller bearing 285*b*.

Rotation of the roller support member 285 about the rotation supporting portion 290 enables the movable roller 284 supported by the roller support member 285 to separate from the fixed roller 283 in accordance with the thickness of the recording medium passing through the nip defined by the pair of the registration rollers 28.

It is to be noted that the movable roller bearing 285*b* is provided to the roller support member 285. The rotary shaft 286 fitted into the movable roller bearing 285*b* may be provided directly or indirectly to the image forming apparatus 100 through another part.

As illustrated in FIG. 2, as a shock absorber, the grease 289 is provided between the movable roller bearing 285*b* and the rotary shaft 286 fitted to the movable roller bearing 285*b*. Hardness or viscosity of the grease 289 produces rotation friction between the movable roller bearing 285*b* and the rotary shaft 286 of the rotation supporting portion 290, thereby absorbing displacement energy in which the movable roller 284 tries to return to the fixed roller 283 side. In other words, the grease 289 absorbs the displacement energy caused by the urging force of the urging member 287 that moves the movable roller 284 to the fixed roller 283. As a result, the urging force of the urging member 287 causing the movable roller 284 to return to the fixed roller side is absorbed by the grease 289, thereby reducing speed of displacement of the movable roller 284.

In view of the above, the grease 289 preferably has a small consistency, that is, the grease 289 is relatively hard. "Consistency" herein refers to a measure or degree of hardness of a grease, such that the larger the number of consistency, the softer the grease Conversely, if the consistency has a small number, it means that the grease is hard. For example, the consistency of grease used generally as a lubricant is approximately 300 (25 C.°/60 W).

By filling the space between the movable roller bearing 285*b* and the rotary shaft 286 of the rotation supporting portion 290 with grease 289, the consistency or the viscosity of the grease 289 generates rotation friction which absorbs the displacement energy caused by the urging force of the urging member 287 that moves the movable roller 284 toward the fixed roller 283, thereby reducing the speed of rotation of the movable roller 284. Accordingly, the speed of displacement of the movable roller 284 urged by the urging member 287 striking the fixed roller 283 is reduced, as is the impact of the movable roller 284 against the fixed roller 283.

It is to be noted that a proper consistency of the grease 289 may be selected as needed depending on an elastic modulus or the like of the urging member 287. The consistency of the grease 289 can be optimized by calculations made during the design stage and/or based on experiments performed using an actual device.

With reference to FIG. 2, a description is now provided of operation of the sheet conveyance device, shown in time series. FIG. 2(*a*) illustrates a state in which the recording medium comes to a position proximal to the nip between the fixed roller 283 and the movable roller 284. As can be seen from FIG. 2(*a*), the recording medium has not entered the nip so that the movable roller 284 is still in contact with the fixed roller 283 due to the urging force of the urging member 287.

Next, as illustrated in FIG. 2 (*b*), the recording medium is conveyed further, thereby entering the nip. The recording medium pushes the roller support member 285 away from the fixed roller 283 against the urging force of the urging member 287. That is, as the recording medium enters the nip, the roller support member 285 rotates about the rotation supporting portion 290, causing the movable roller 284 supported by the roller support member 285 to separate from the fixed roller 283 by an amount corresponding to the thickness of the recording medium. As a result, the urging member 287 stretches by the same amount of the thickness of the recording medium.

Furthermore, as illustrated in FIG. 2(*c*), when the rear end of the recording medium passes through the nip, the urging member 287 being stretched springs back to its original state due to its urging force. That is, the movable roller 284 moves to the fixed roller 283 such that the movable roller 284 and the fixed roller 283 contact again, forming the nip.

According to the illustrative embodiment, when the movable roller 284 moves to the fixed roller 283, the friction caused by the consistency of the grease 289 provided between the movable roller bearing 285*b* and the rotary shaft 286 absorbs the displacement force or displacement energy of the urging member 287 moving back to the fixed roller side. In this configuration, the speed of displacement of the movable roller 284 is reduced, thus alleviating the shock of impact when the movable roller 284 strikes the fixed roller 283 and resulting ultimately in reduction of vibration of the pair of registration rollers 28, that is, the fixed roller 283 and the movable roller 284.

With reference to FIGS. 3 and 4, a detailed description is provided of the sheet conveyance device employing the pair of the registration rollers 28 shown in FIG. 2 according to the illustrative embodiment. FIG. 3, is a schematic perspective view of the sheet conveyance device having the pair of the registration rollers 28. FIG. 4 is a partially enlarged view of a shaft bearing portion B of the pair of the registration rollers of FIG. 3.

As described above, the pair of the registration rollers 28 includes the fixed roller 283 serving as the drive roller and the movable roller 284 that contacts the fixed roller 283, together forming the nip.

One end of the fixed roller 283 is provided with a drive gear 301 which transmits drive force from a drive source, not illustrated, to the fixed roller 283. As the drive force is transmitted to the drive gear 301, the fixed roller 283 is rotated.

As illustrated in FIG. 4, the shaft of the fixed roller 283 is rotatably supported by a fixed roller bearing 300. The position of the fixed roller bearing 300 is fixed by a roller support bracket 291 attached to the main body of the image forming apparatus 100. With this configuration, the fixed roller 283 is rotated by the drive force of the drive source while the position of the fixed roller 283 is fixed to the main body of the image forming apparatus 100.

An urging member support bracket 292 is mounted on the roller support bracket 291. One end of the urging member 287 is connected to the urging member support bracket 292, and other end of the urging member 287 is connected to the roller support member 285 which rotatably supports the shaft of the movable roller 284 at the movable roller bearing 285*b*.

The rotation supporting portion 290 is provided to one end portion of the roller support member 285, which is the opposite end to which the urging member 287 is connected. As described above, the rotation supporting portion 290 includes the movable roller bearing 285*b* provided to the roller support member 285 and the rotary shaft 286 fitted into the movable roller bearing 285*b* disposed on the roller support bracket 291*a*.

As described with reference to FIG. 2, the grease 289 is provided between the movable roller bearing 285*b* and the rotary shaft 286, thereby generating rotation resistance relative to the movement of the movable roller 284.

It is to be noted that although only one end of the pair of the registration rollers 28 is shown, the bearing portions 285*a* and 285*b* are provided mirror-symmetrically at the other end of the registration rollers 28 as can be seen from FIG. 3.

The urging member 287 illustrated in FIGS. 3 and 4 is a pressure spring. When the recording medium is not conveyed, the urging member 287 urges the movable roller 284 against the fixed roller 283 to contact at an initial tension of 0.764 N, with the spring length 17.8 mm, thereby forming the nip.

By contrast, when the recording medium is conveyed, the tension of the urging member 287 is 7 N with the length thereof 23.9 mm. Therefore, the elastic modulus of the urging member 287 is 1.2 N/mm.

The present inventors confirmed that shock jitter disappears when using the grease 289 having a consistency in a range of 200 to 250 (25 C.°/60 W) and using the urging member 287 with the elastic modulus 1.2 N/mm. Thus, it is preferable to use the grease 289 having the consistency in the range of 200 to 250 (25 C.°/60 W).

Referring now to FIG. 5, there is provided a schematic cross-sectional diagram illustrating another example of shock absorber according to the illustrative embodiment. According to the present embodiment, the sheet conveyance device illustrated in FIG. 5 employs a damper 288 serving as the shock absorber instead of the grease 289.

The damper 288 is formed of a known damper and is connected to one end portion of the roller support member 285, opposite an end where the rotation supporting portion 290 is provided. The damper 288 acts in a direction opposite the urging force of the urging member 287 that moves the movable roller 284 to the fixed roller 283.

As is well known to those skilled in the art, the damper 288 is a well-known device that absorbs energy exerted from outside due to deformation of a spring or the like and generates resistance against compressing movement caused by an external force.

According to the illustrative embodiment, the damper 288 generates resistance which acts against the displacement energy/force of the movable roller 284 moving toward the fixed roller 283 when the urging member 287 shrinks, thereby absorbing the displacement energy/force of the movable roller 284 toward the fixed roller 283 due to the urging member 287.

As described above, a known damper can be used as the damper 288. For example, an oil-type damper or mechanical damper can be used. The damper 288 illustrated in FIG. 5 is an oil-type. One end of a piston of the damper 288 is connected to one end of the roller support member 285, and a cylinder portion of the damper 288 is connected to the main body of the image forming apparatus 100. A damping value or damping force of the damper 288 can be optimized by calculations performed during the design stage and/or based on experiments using an actual device.

According to the illustrative embodiment, the damper 288 is connected to one end of the roller support member 285. However, the position of the damper 288 is not limited thereto. Insofar as the damper 288 works against the direction of urging energy/force of the urging member 287 that moves the movable roller 284 to the fixed roller 283, the damper 288 can be disposed at any place on the roller support member 285.

With reference to FIG. 5, a description is provided of operation of the sheet conveyance device on the time series. Similar to FIG. 2(*a*), FIG. 5(*a*) illustrates a state in which the recording medium comes to a position proximal to the nip between the fixed roller 283 and the movable roller 284. Similar to FIG. 2(*b*), FIG. 5(*b*) illustrates a state in which the recording medium is conveyed further, thereby entering the nip.

In FIG. 5(*a*), the recording medium has not entered the nip. Because the recording medium has not entered the nip, the movable roller 284 is in contact with the fixed roller 283 due to the urging force exerted by the urging member 287, thereby forming the nip.

By contrast, when the recording medium advances to the nip as illustrated in FIG. 5(*b*) pushing the movable roller 285 away from the fixed roller 283 against the urging force of the urging member 287, the movable roller 284 separates from the fixed roller 283 by an amount corresponding to the thickness of the recording medium.

Subsequently, as the recording medium advances further, that is, the rear end of the recording medium passes through the nip as illustrated in FIG. 5(*c*), the urging member 287 that has been stretched by an amount equal to the thickness of the recording medium shrinks back to its original shape by its own urging force. In other words, the movable roller 284 moves back to the fixed roller 283 such that the fixed roller 283 and the movable roller 284 meet and contact again.

As the movable roller 284 moves back to the fixed roller 283, the damper 288 provided to one end of the roller support member 285 absorbs the displacement energy/force of the movable roller 284 moving back to the fixed roller 283 caused by the urging member 287, thereby alleviating shock generated by the movable roller 284 striking the fixed roller 283. As a result, vibration is reduced, if not prevented entirely, between the pair of the registration rollers 28 (the movable roller 284 and the fixed roller 283).

The foregoing description pertains to examples of the shock absorber employed when the position of the movable roller 284 is changed using roller support member 285. However, the present invention is not limited to any of the structure for performing the methodology illustrated in the drawings. In so far as the shock absorber that absorbs the displacement energy of a movable roller striking a fixed roller due to an urging member after the recording medium passes through the nip is provided, the same effect may be achieved.

For example, though not illustrated, the urging member 287 can be connected directly to the shaft bearing portion 285*a* that rotatably support the movable roller 284 so as to urge the movable roller 284 to contact the fixed roller 283, thereby forming the nip. Further, the shaft bearing portion 285*a* is extended in the longitudinal direction of the roller. The damper 288 can be disposed on the extended portion of the shaft bearing portion 285*a*.

In this configuration, the roller support member 285 as illustrated in FIGS. 2 and 5 is omitted. Instead, only the shaft bearing portion 285*a*, which rotatably support the movable roller 284, is employed as the roller support member, and the urging member 287 is connected directly to shaft bearing portion 285*a* serving as the roller support member.

Even when the movable roller 284 makes translatory displacement motion in which the movable roller 284 moves left and right in parallel on the plane of FIG. 5, providing the damper 288 on the shaft bearing portion 285*a* can attain the similar, if not the same effect as that of the illustrative embodiments described above.

In this configuration, because the movable roller 284 makes the translatory displacement motion, the movable roller 284 serves as a translatory roller. The shaft bearing portion 285*a* serves as the shaft bearing portion for the translatory roller.

In order to enable the shaft bearing portion 285*a* to make left-and-right parallel translatory motion on the plane of FIGS. 5A through 5C, a guide member that guides the translatory displacement of the shaft bearing portion 285*a* is provided on a plate member fixedly attached directly to or indirectly to the main body of the image forming apparatus.

The guide member on the plate member is, for example, a slot into which shaft bearing portion 285*a* is fitted, thereby guiding the movable roller 284 in the direction of translatory displacement.

Furthermore, both the damper 288 of FIG. 5 and the grease 289 of FIG. 2 may be provided as a shock absorber. Having both the damper 288 and the grease 289 provides greater flexibility in optimization of the relation between the urgent force of the urging member 287 and the displacement speed of the movable roller 284 moving to the fixed roller 283.

If there is no room for the damper 288 in the image forming apparatus, the grease 289 alone can adjust the displacement speed of the movable roller. On the contrary, if a grease having the desired consistency is not available, the damper 288 alone can adjust the displacement speed of the movable roller.

According to the illustrative embodiment, the present invention is employed in the sheet conveyance device using a pair of registration rollers in the electrophotographic full-color printer as an example of the image forming apparatus. However, the present invention is not limited to the image forming apparatus described above.

The present invention can be applied to any other sheet conveyance devices using a fixed roller and a movable roller.

The image forming apparatus includes, but is not limited to, a copier, a printer, a facsimile machine, and a multi-functional system including two or more functions.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image forming device; and a sheet conveyance device to convey a recording medium, the sheet conveyance device including:

a fixed roller, the position of which is fixed;

a movable roller disposed opposite the fixed roller, to contact the fixed roller, thereby defining a nip, so that the recording medium enters the nip defined between the fixed roller and the movable roller, in which a conveyance direction of the recording medium entering the nip is at a substantially vertical direction in relation to a stack sheet of recording medium;

an urging member to urge the movable roller to contact the fixed roller in the absence of the recording medium in the nip, and allow the movable roller to separate from the fixed roller by an amount corresponding to a thickness of a recording medium when the recording medium enters the nip; and a shock absorber to absorb displacement energy generated when the urging member urges the movable roller to contact the fixed roller again after the recording medium passes through the nip, wherein the movable roller, disposed at a same side of the image forming device, is supported by a movable roller support member to which the urging member is connected thereto, wherein the movable roller is positioned at a center of the movable roller support member causing the movable roller support member to pivot at the center thereof, wherein the movable roller support member includes a pivotal supporting portion, in which the pivotal supporting portion is disposed entirely at the same side as the movable roller with respect to the image forming device, and wherein the pivotal supporting portion is provided at one end of the movable roller support member, and the urging member is provided at an opposite end of the movable roller support to which pivotal supporting portion is connected thereto.

2. The image forming apparatus according to claim 1, wherein the pivotal supporting portion includes:

a movable roller bearing; and a rotary shaft fitted into the movable roller bearing, defining a pivot point of the movable roller support member, wherein pivotal movement of the movable roller support member about the pivot point causes the movable roller to separate from the fixed roller.

3. The image forming apparatus according to claim 2, wherein the shock absorber is provided between the movable roller bearing and the rotary shaft of the movable roller support member.

4. The image forming apparatus according to claim 3, wherein the shock absorber is grease.

5. The image forming apparatus according to claim 4, wherein a consistency of the grease is in a range of 200 to 250 (25 C.°/60 W).

6. The image forming apparatus according to claim 2, wherein the shock absorber is a damper connected to the movable roller support member and acts in a direction opposite an urging force of the urging member that moves the movable roller to the fixed roller.

7. The image forming apparatus according to claim 2, wherein the shock absorber includes both a grease and a damper.

8. The sheet conveyance device according to claim 2, wherein the pivotal supporting portion is provided to one end of the movable roller support member, which is disposed at an opposite end to which the urging member is connected.

9. A sheet conveyance device to convey a recording medium, comprising:

a fixed roller, the position of which is fixed;

a movable roller disposed opposite the fixed roller, to contact the fixed roller, thereby defining a nip;

an urging member to urge the movable roller to contact the fixed roller in the absence of the recording medium in the nip, and allow the movable roller to separate from the fixed roller by an amount corresponding to a thickness of a recording medium when the recording medium enters the nip;

a shock absorber to absorb displacement energy generated when the urging member urges the movable roller to contact the fixed roller again after the recording medium passes through the nip; and a movable roller support member to which the urging member is connected thereto, the movable roller support member being pivotally supported by a pivotal supporting portion, wherein the movable roller is positioned at a center of the movable roller support member causing the movable roller support member to pivot at the center thereof, wherein the movable roller support member includes the pivotal supporting portion, the movable roller, and the urging member in this order from an upstream in a direction of transport of the recording medium, wherein the pivotal supporting portion is disposed entirely at the same side as the movable roller with respect to the image forming device, and wherein the pivotal supporting portion is provided at one end of the movable roller support member, and the urging member is provided at an opposite end of the movable roller su ort to which pivotal supporting portion is connected thereto.

10. The sheet conveyance device according to claim 9, wherein the pivotal supporting portion includes:

a movable roller bearing provided to the movable roller support member; and a rotary shaft fitted into the movable roller bearing, defining a pivot point of the movable roller support member.

11. The sheet conveyance device according to claim 10, wherein the shock absorber is provided between the movable roller bearing and the rotary shaft of the movable roller support member.

12. The sheet conveyance device according to claim 11, wherein the shock absorber is grease.

13. The sheet conveyance device according to claim 12, wherein a consistency of the grease is in a range of 200 to 250 (25 C.°/60 W).

14. The sheet conveyance device according to claim 10, wherein the shock absorber is a damper connected to the movable roller support member and acts in a direction opposite an urging force of the urging member that moves the movable roller to the fixed roller.

15. The sheet conveyance device according to claim 10, wherein the shock absorber includes both a grease and a damper.

16. The sheet conveyance device according to claim 9, wherein the pivotal supporting portion is provided to one end of the movable roller support member, which is disposed at an opposite end to which the urging member is connected.

17. The image forming apparatus according to claim 1, wherein the movable roller support member moves pivotally about a pivot point so as to cause the movable roller to separate from the fixed roller.

18. The image forming apparatus according to claim 1, wherein the movable roller support member includes a pivotal supporting portion, the pivotal supporting portion includes:

a movable roller bearing; and a rotary shaft fitted into the movable roller bearing, defining a pivot point of the movable roller support member.

19. The image forming apparatus according to claim 18, wherein the pivotal supporting portion is provided to one end of the movable roller support member, which is opposite end to which the urging member is connected.

* * * * *